United States Patent [19]

Cheng

[11] Patent Number: 5,056,776

[45] Date of Patent: Oct. 15, 1991

[54] BABY WALKER CHAIR AND DESK ASSEMBLY

[75] Inventor: Chen J. Cheng, Tainan, Taiwan

[73] Assignee: Petrus Imports, Inc., Framingham, Mass.

[21] Appl. No.: 529,142

[22] Filed: May 25, 1990

[51] Int. Cl.[5] ..... A63B 25/00; B62B 9/12

[52] U.S. Cl. ..... 272/70.3; 280/87.051; 297/5

[58] Field of Search ..... 272/70.3, 93, 70.4; 297/5, 6; 280/43.24, 87.051, 87.02 W

[56] References Cited

U.S. PATENT DOCUMENTS

| | | | |
|---|---|---|---|
| 4,093,208 | 6/1978 | Tomalinas | 297/5 |
| 4,364,576 | 12/1982 | Kassai | 272/70.3 |
| 4,822,030 | 4/1989 | Cone | 272/70.3 |

*Primary Examiner*—Stephen R. Crow

*Attorney, Agent, or Firm*—Wolf, Greenfield & Sacks

[57] ABSTRACT

A chair and desk board assembly for a baby walker is provided in which the desk board has a front tray and a rear frame defining a chair hole. Horizontal holes are provided in a rear periphery of the tray and vertical holes are provided in the top surface of the rear frame. The chain has a substantially U-shaped member and an inner seat both made from a foam-like material, and studs are provided on a front surface of the chair for engagement with the horizontal holes. A mounting member having a curved wall conforming to the contour of the U-shaped member of the chair is provided and fits into the U-shaped member. Resilient tongues extend downward from the mounting member to engage the vertical holes of the desk board.

11 Claims, 4 Drawing Sheets

BABY WALKER CHAIR AND DESK ASSEMBLY

BACKGROUND OF THE INVENTION

1. Field of the Invention

This invention relates to a baby walker, and in particular to an improvement in the assembly of a chair and a desk therefore.

2. Detailed Description of the Prior Art

Baby walkers have existed in various forms. A typical baby walker is shown in FIGS. 1–3, wherein a substantially elliptical desk 100 is mounted on a support B. The desk 100 has a recessed portion or tray 11 formed in the upper surface, and a frame 13 extending from the tray 11 so that it surrounds and forms a rear hole 12 for receiving a chair 200.

To assemble the chair and the desk, positioning holes 15 and 18 are provided in the top and front portions of the frame 13 for engagement with armrests and studs 23 on a front portion 22 of the chair 200, respectively. Screw holes 14 in the upper surface of the rear portion of the frame 13 receive bolts 24, which extend into positioning blocks 211 provided adjacent the backrest 21 of the chair. Wing nuts 16 lock the desk 100 against the chair 200. Such a chair and desk configuration is disadvantageous because it requires a two-step assembly process. The studs 23 of the chair must be fitted into the positioning holes 18 of the desk, and the back of the chair must be screwed to the desk with the bolts 24, wing nuts 16 and positioning blocks 211. This operation is cumbersome and time consuming and requires a significant number of parts. As a consequence the baby walker shown in FIGS. 1–3 is expensive to produce and assemble.

SUMMARY OF THE INVENTION

An object of the invention is to provide a baby walker having a chair and desk which can be assembled easily and requires relatively few parts.

According to the present invention, an improved chair and desk assembly for a baby walker includes a desk having a front tray and a rear frame with an inner periphery defining a chair/mounting hole. Horizontal holes are provided in a rear surface of the inner periphery of the desk and vertical holes are provided in the upper surface of the rear frame. A chair having a substantially U-shaped back member and an interconnected inner seat are both made of a foam like material. A front plate is provided across the U-shaped member and has forwardly projecting studs for engaging the horizontal holes of the desk. A bottom foldable flange extends outwardly from the rear surface of the U-shaped member of the chair and has a plurality of apertures provided therein. A rigid mounting member having a curved wall conforming to the contour of the U-shaped member of the chair fits into the U-shaped member. Engaging tongues extend downward from the curved wall and through the apertures in the flange when the flange is folded inwardly, and engage the vertical holes of the rear frame of the desk board.

In one form of the invention, a baby walker has a substantially horizontal desk defining a chair mounting hole and having a continuous peripheral edge with a border area of the desk surrounding the edge. A baby chair is dimensioned to be fit within the peripheral edge and carries a mounting flange arranged to overlie at least a portion of the border area. A chair mounting member overlies the flange and sandwiches the flange between the mounting member and the desk border area. The mounting member and the desk carry resilient snap together locking means passing through the flange to releasably lock the chair to the desk.

BRIEF DESCRIPTION OF THE DRAWINGS

The preferred embodiment of the invention will be described in detail with reference to the accompanying drawings, in which.

DETAILED DESCRIPTION OF THE PREFERRED EMBODIMENT

Figure 4:
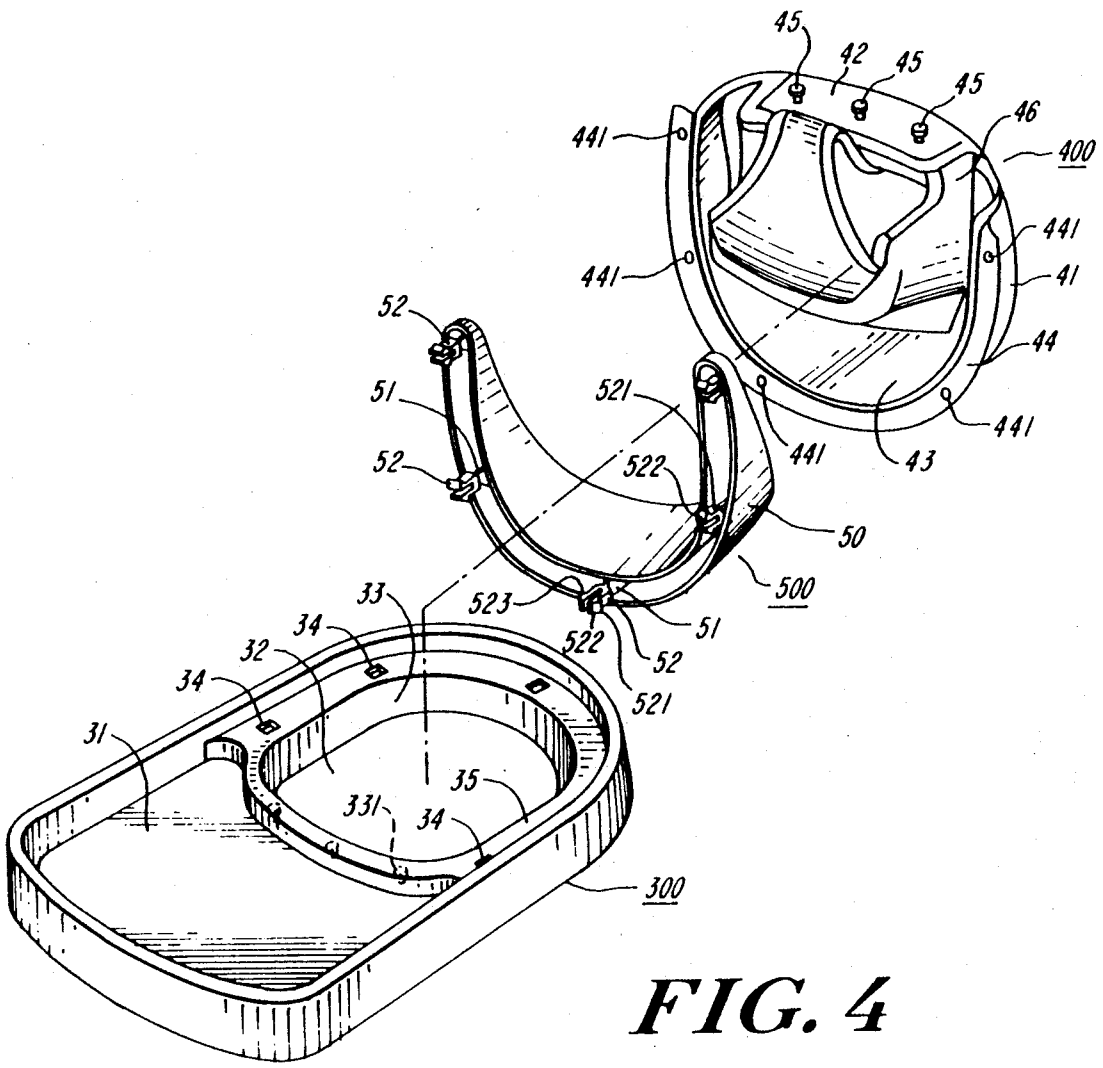
FIG. 4 is an exploded perspective view of the chair and desk assembly for a baby walker according the present invention.
Figure 6:
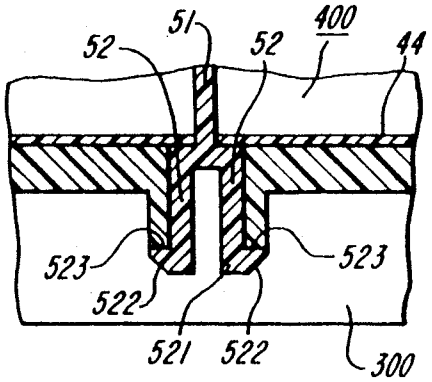
FIG. 6 is a cross sectional view showing engagement between a tongue of the mounting member and a hole of the desk of the baby walker illustrated in FIGS. 4 and 5.
Figure 5:
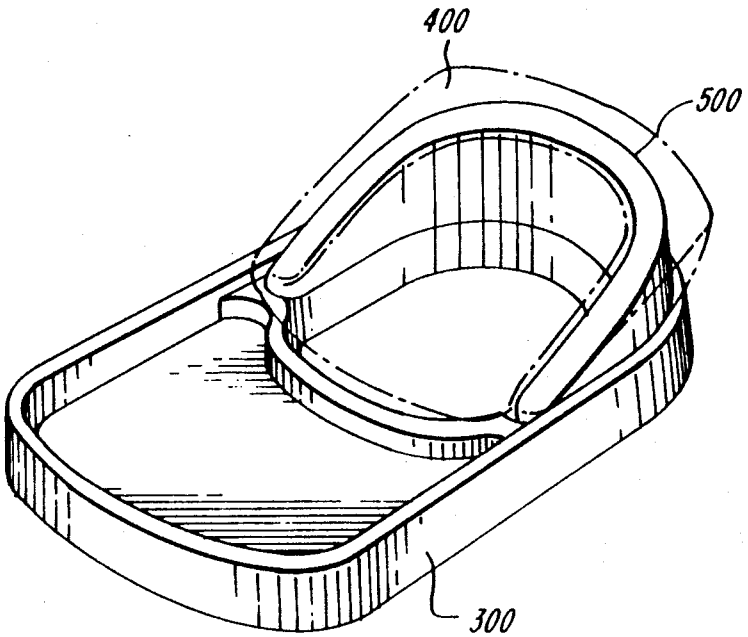
FIG. 5 is a perspective view of an assembled baby walker as illustrated in FIG. 4 with the outline of the chair shown in phantom lines.

Referring to FIGS. 4–6, a portion of a baby walker is shown, having a desk 300, a chair 400 and a mounting member 500. The desk 300 defines a chair mounting hole 32 and has a continuous peripheral edge 33 with a border area 35, and a desk tray 31 located in the front of the desk 300. Horizontal locking holes 331 are provided in the peripheral edge 33 adjacent to the desk tray 31 facing inward towards the chair mounting hole 32. Vertical locking holes 34 are provided in the top surface of the border area 35.

The chair 400 is dimensioned to fit within the peripheral edge 33 and carries a mounting flange 41 arranged to overlie at least a portion of the border area 35. The chair 400 includes a substantially U-shaped member 41 and a seat 46 both of which are made of a foam like material. A front plate 42 is attached to the U-shaped member 41 and has studs 45 projecting forwardly therefrom to engage with the horizontal locking holes 331. A mounting flange 44 is attached to the bottom edge of the U-shaped member 41 and has a substantially U-shaped contour extending outward from the rear and two sides of the U-shaped member 41. Slots or holes 441 are provided in the flange 44. The seat 46 is connected to and received in the hole 43 of the U-shaped member 41.

The chair mounting member 500 has a curved wall 50 with a substantially U-shaped contour. The chair mounting member 500 overlies the flange 44 and sandwiches the flange 44 between the mounting member 500 and the desk border area 35. The mounting member 500 and the desk carry resilient snap together locking means 52 passing through the slots 441 in the flange 44 to releasably lock the chair 400 to the desk 300.

In the illustrated embodiment, tongues 52 extend downward from the wall 50. If the curved wall 50 is hollow, brace members 51 are provided for supporting the tongues 52 so that they extend below the bottom edge of the hollow wall. Each tongue 52 divides or forks and thus is horizontally resilient, and has two butt ends 521 each with a slanted sliding face 522 and an engaging face 523.

To assembly, the mounting member 500 is fitted to the chair 400 and the flange 44 is folded inward so that the tongues 52 on the mounting member 500 extend through the holes 441. The chair 4 is fitted into the chair mounting hole 32 of the desk 300, so that the studs 45 fit into the horizontal holes 331, and the tongues 52 fit into the holes 34 in the border area 35 of the desk 300. The chair 400, the mounting member 500 and the desk 300 can be locked together merely by pressing the chair 4 against the desk with moderate force.

The tongues 52 engage the holes 34 as shown in FIG. 6 to hold the chair 400 and the desk 300 firmly together. As the tongues 52 enter the holes 34, the slanted faces 522 engage the edges of the holes 34 inwardly pressing the split portions of the tongues 52. When the tongues 52 extend far enough into the holes 34, the butt ends 521 spring back due to their inherent resiliency. The engaging faces 523 engage the bottom portions of the holes 34 to firmly mount the chair within the desk 300.

Figure 3:
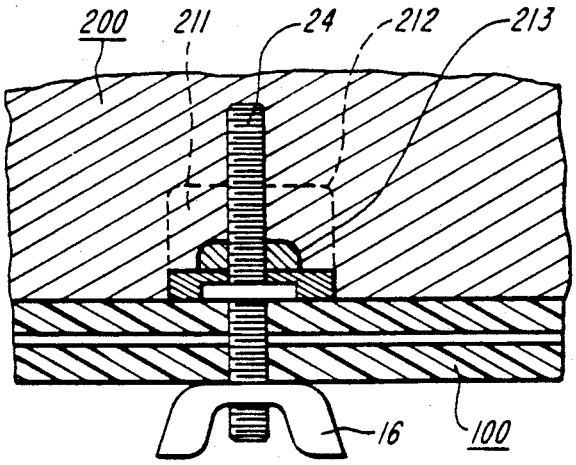
FIG. 3 (PRIOR ART)
FIG. 3 is a cross-sectional view showing the engagement of the desk board and chair of the seat illustrated in FIGS. 1 and 2.

It will be appreciated that the chair 400 is attached to the desk solely by the engagement of the studs 45 and the tongues 52, respectively, with the holes 331 and 34. Such engagement of the tongues 52 with the holes 34 can be more easily accomplished than the attachment of fastening screws which are used in the prior art baby walker shown in FIGS. 1–3. The desk 300, and mounting member 500 can be made from injection molded plastic. The baby walker of the present invention thus has fewer parts and is easier to assemble than the prior art walker of FIGS. 1–3.

The chair and desk board of the baby walker are detached simply by pressing the butt ends 521 of the tongues 52 towards one another and pressing the tongues out of the holes 34.

Although the above specific embodiment describe a preferred arrangement, many variations will be obvious to those skilled in the art. For example, the size and general configuration of the accommodation hole 32 can vary greatly. Although U-shaped members are preferred for the mounting member and seat, that configuration can change with the configuration of hole 32 as desired. Preferably the desk is rigid as is the mounting member 500 while the chair 400 can be rigid or have resilient moveable components. Plastics either hard, foamed or otherwise can be used for all components. It is preferred that the mounting member 500 be formed of a rigid material to firmly clamp the flange 44 between a border area 35 around the hole 32 in itself and thus firmly support the chair even if the chair is not of a rigid material. When the chair is of the rigid material, the chair itself may provide for support against the weight of a child within the chair. When a rigid material is used for the chair, the flange 44 is originally directed inwardly other than is shown in the figure and it is unnecessary to bend it over just prior to the mounting member on the desk. When the chair is of a fabric or vinyl covered fabric and the like, the clamping action of the mounting member to the desk is important to firmly grip the flange and thus support the chair. The raised portion of the mounting member can also support the back of the chair as for example, where the numeral 500 appears in FIG. 5, that upper edge shown can support the chair back. Similarly, the mounting member can have other configurations to provide greater or less rigid support to a non-rigid chair back mounted on the desk.

Figure 1:
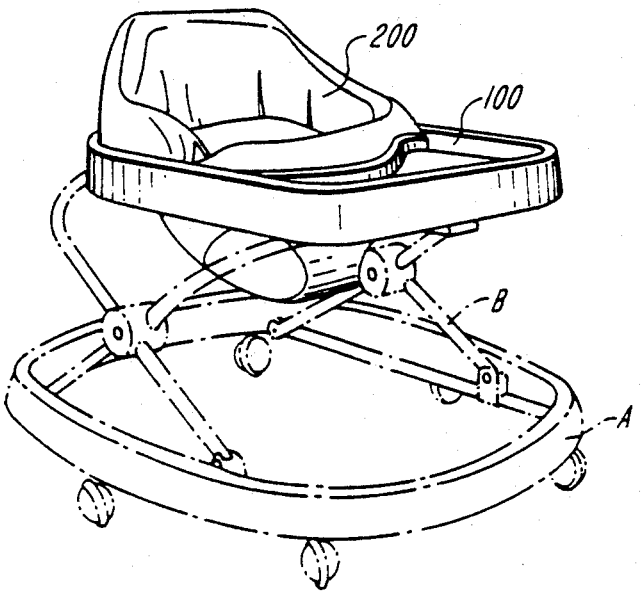
FIG. 1 (PRIOR ART)
FIG. 1 is a perspective view of a baby walker of the prior art.
Figure 2:
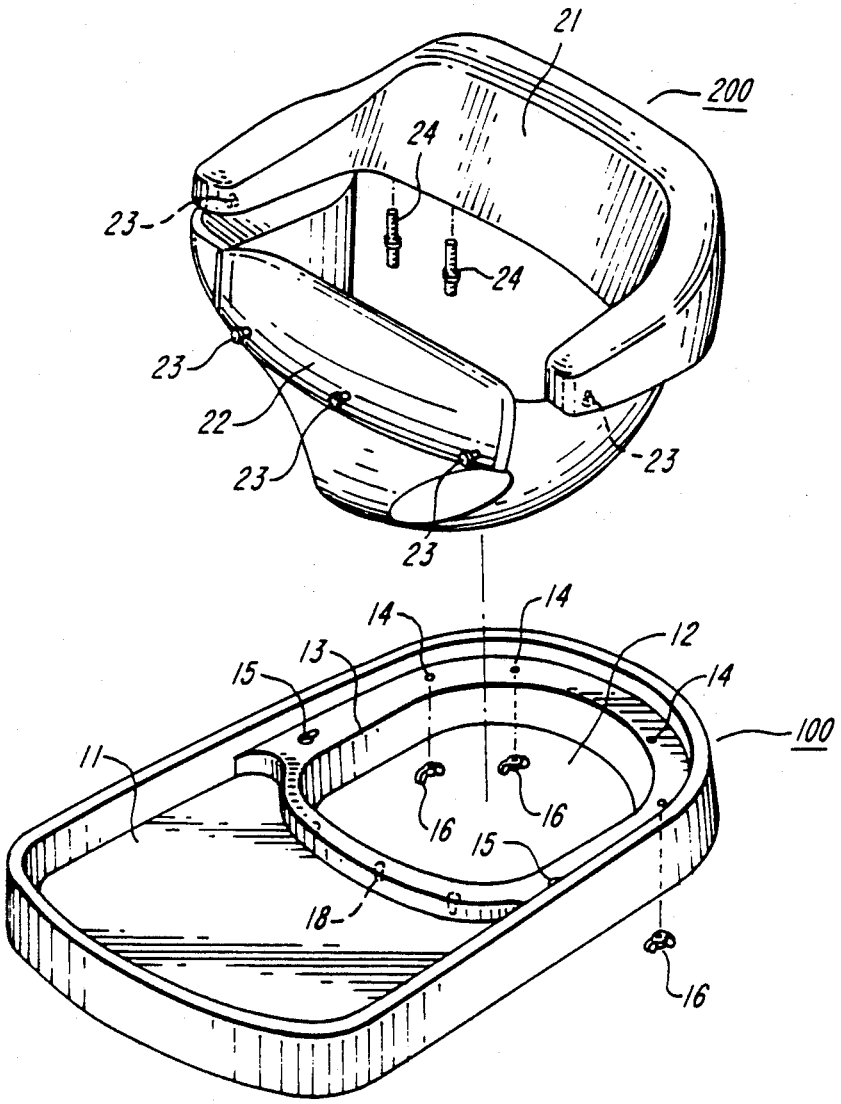
FIG. 2 (PRIOR ART)
FIG. 2 is an exploded perspective view of the baby walker shown in FIG. 1.

The walker frame as shown in FIG. 1 can be used to support the desk in accordance with known practice although other frames and supports may be used. The tongues as shown in FIG. 6 provide a positive firm locking member which is easily assembled. A mere pressing action is needed. However, the shape and size of the resilient locking member can vary in accordance with known resilient interlocking members in the art. The tongues are preferred since they provide positive action against movement of the mounting frame in the plane of the desk having flat sides and flat ends. Moreover, the tongues can be made of sufficient thickness to provide substantial strength through the interlock of the flange with the desk through the use of the frame. Of course, if desired, the mounting member can have holes and the tongues can be provided on the desk although the arrangement shown is preferred for versatile use of the desk with different chair interlock members.

With the invention thus explained, it is apparent that numerous modifications and variations can be made without departing from the scope of the invention. It is therefore intended that the invention be limited as indicated only in the appended claims.

I claim:

1. A baby walker chair and desk assembly comprising:

a desk having a chair mounting hole defined by a peripheral edge, and vertical holes provided in an upper surface of said desk around said mounting hole;

having an inner seat and a foldable flange having a plurality of apertures disposed therein;

a rigid mounting member conforming to the contour of said chair, and having engaging means engaging said vertical holes in said desk; and means extending through said apertures in said flange when said flange is folded inwardly, and said flange is clamped between said rigid mounting member and said upper surface of said desk, thereby releasbly locking said chair to said desk.

2. A baby walker as recited in claim 1, wherein said chair and said inner seat are formed from non-rigid, pliable foam-like material.

3. A baby walker as recited in claim 1, wherein said mounting member has a hollow curved wall.

4. A baby walker as claimed in claim 3, wherein braces are provided in the interior of said hollow curved wall extending to the bottom of said wall and said engaging means extends down from the lower portions of said braces.

5. A baby walker as claimed in claim 1, wherein said engaging means comprises tongues split into two resilient parallel members which are normally biased outwardly.

6. A baby walker as claimed in claim 5, wherein said tongues further comprise slanting surfaces for biasing said split portions inwardly as said tongues are moved through said vertical holes.

7. A baby walker as claimed in claim 6, wherein said tongues further comprising engaging surfaces for engaging a bottom portion of said holes to maintain said chair, said mounting member and said desk in an attached condition.

8. A baby walker comprising a desk adapted to lie substantially horizontal and defining a baby chair mounting hole extending generally vertically and defining a continuous peripheral edge with a border area of said desk surrounding said edge, a baby chair designed to fit within said peripheral edge and carrying a mounting flange arranged to overlie at least a portion of said border area, a chair mounting member overlying said flange and sandwiching said flange between said mounting member and said desk border area, said mounting member and said desk carrying resilient snap together locking means passing through said flange to releasably lock said chair to said desk.

9. A baby walker in accordance with claim 8, wherein said locking means comprises plastic, resilient tongues on said mounting member extending through holes defined by said flange and into locking holes which resiliently engage said tongues to maintain said seat in position and supported against separation from said desk when a child is positioned in said seat and said desk is supported above the ground by a baby walker frame means.

10. A baby walker in accordance with claim 9, wherein said chair further defines a plurality of locking means for directly interlocking with a portion of said desk about said peripheral edge.

11. A baby walker chair and desk assembly comprising:

a desk having a chair mounting hole defining a peripheral edge, and vertical holes provided in an upper surface of said desk surrounding said mounting hole;

a chair having an inner seat and a foldable flange having a plurality of apertures disposed therein, said chair and inner seat being formed from non-rigid pliable foam-like material;

a rigid mounting member conforming to the contour of said chair, and having engaging means engaging said vertical holes in said desk, and means extending through said apertures in said flange when said flange is folded inwardly, and said flange is clamped between said rigid mounting member and said upper surface of said desk, wherein said engaging means comprises tongues split into two resilient parallel members which are normally biased outwardly.

* * * * *